US009528733B2

(12) United States Patent
Kato et al.

(10) Patent No.: US 9,528,733 B2
(45) Date of Patent: Dec. 27, 2016

(54) AIR-CONDITIONING APPARATUS

(75) Inventors: Yohei Kato, Tokyo (JP); Makoto Saito, Tokyo (JP); Naoki Wakuta, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 984 days.

(21) Appl. No.: 13/504,321

(22) PCT Filed: Nov. 8, 2010

(86) PCT No.: PCT/JP2010/006534
§ 371 (c)(1),
(2), (4) Date: Apr. 26, 2012

(87) PCT Pub. No.: WO2011/058726
PCT Pub. Date: May 19, 2011

(65) Prior Publication Data

US 2012/0210742 A1 Aug. 23, 2012

(30) Foreign Application Priority Data

Nov. 11, 2009 (JP) ..... 2009-257800

(51) Int. Cl.
*F25B 49/00* (2006.01)
*F25B 31/00* (2006.01)
*F25B 13/00* (2006.01)

(52) U.S. Cl.
CPC ..... *F25B 31/00* (2013.01); *F25B 13/00* (2013.01); *F25B 2400/01* (2013.01);
(Continued)

(58) Field of Classification Search
CPC ..... F25B 40/00; F25B 40/06; F25B 43/00; F25B 1213/008
(Continued)

(56) References Cited

U.S. PATENT DOCUMENTS 2,175,913 A * 10/1939 Philipp ..... 417/294
3,705,499 A * 12/1972 Mount et al. ..... 62/84
(Continued)

FOREIGN PATENT DOCUMENTS

JP 61-276663 A 12/1986
JP 62-94772 A 5/1987
(Continued)

OTHER PUBLICATIONS

Japanese Office Action (Decision of Rejection) dated Oct. 8, 2013, issued by the Japanese Patent Office in corresponding Japanese Patent Application No. 2011-247976, and English language translation of Office Action. (4 pages).
(Continued)

*Primary Examiner* — M. Alexandra Elve
*Assistant Examiner* — Alexis Cox
(74) *Attorney, Agent, or Firm* — Buchanan Ingersoll & Rooney PC

(57) ABSTRACT

An air-conditioning apparatus, including a refrigerant circuit connecting a compressor, a heat source side heat exchanger, an expansion valve, and a use side heat exchanger in order with a refrigerant piping. A compressor heater is provided for heating the compressor when the compressor is not in operation. A compressor temperature sensor is provided for detecting a compressor temperature. A refrigerant temperature detection sensor is provided for detecting a refrigerant temperature in the compressor. A controller is configured to estimate an amount of liquid refrigerant in the compressor by integrating the temperature difference between the compressor temperature and the refrigerant temperature during a period in which the compressor temperature becomes lower than the refrigerant temperature, and control the heating operation, which is carried out by the compressor heater, on
(Continued)

the basis of the estimated liquid refrigerant amount when the compressor is not in operation.

5 Claims, 11 Drawing Sheets

(52) U.S. Cl.
CPC ..... *F25B 2500/16* (2013.01); *F25B 2500/19* (2013.01); *F25B 2500/26* (2013.01); *F25B 2500/31* (2013.01); *F25B 2700/04* (2013.01); *F25B 2700/193* (2013.01); *F25B 2700/2105* (2013.01); *F25B 2700/2106* (2013.01); *F25B 2700/2115* (2013.01)

(58) Field of Classification Search
USPC ..... 62/472
See application file for complete search history.

(56) References Cited

U.S. PATENT DOCUMENTS

| | | | | |
|---|---|---|---|---|
| 5,012,652 | A * | 5/1991 | Dudley | 62/192 |
| 5,661,982 | A * | 9/1997 | Bae | F25B 49/046 62/106 |
| 8,720,212 | B2 * | 5/2014 | Wakuta et al. | 62/193 |
| 2003/0212346 | A1 * | 11/2003 | Yuzhakov | A61B 5/15146 600/584 |
| 2009/0314017 | A1 | 12/2009 | Nishimura et al. | |
| 2010/0162742 | A1 | 7/2010 | Shimoda et al. | |
| 2010/0196170 | A1 * | 8/2010 | Chen | F04B 39/0207 417/228 |
| 2011/0048046 | A1 * | 3/2011 | Sommer | F04D 17/12 62/228.1 |
| 2013/0091891 | A1 * | 4/2013 | Hinde | F25B 43/02 62/470 |
| 2015/0330688 | A1 * | 11/2015 | Goel | F25B 49/022 62/115 |

FOREIGN PATENT DOCUMENTS

| | | | |
|---|---|---|---|
| JP | 62-96791 | A | 5/1987 |
| JP | 1-300149 | A | 12/1989 |
| JP | 05-172409 | A | 7/1993 |
| JP | 6-18103 | A | 1/1994 |
| JP | 8-28987 | A | 2/1996 |
| JP | 08-261571 | A | 10/1996 |
| JP | 9-113039 | A | 5/1997 |
| JP | 11-294877 | A | 10/1999 |
| JP | 2000-292014 | A | 10/2000 |
| JP | 2001-73952 | A | 3/2001 |
| JP | 2004-28503 | A | 1/2004 |
| JP | 2007-163106 | A | 6/2007 |
| JP | 2008-064447 | A | 3/2008 |
| JP | 4111246 | B2 | 7/2008 |
| WO | WO 2008/018381 | A1 | 2/2008 |

OTHER PUBLICATIONS

Japanese Office Action (Notice of Reasons for Rejection) dated Mar. 12, 2013, issued in corresponding Japanese Patent Application No. 2011-247976, and English language translation of Office Action. (7 pages).

Japanese Office Action (Notification of Reason for Refusal) dated Sep. 13, 2011, issued in corresponding Japanese Patent Application No. 2009-257800, and English language translation of Office Action. (6 pages).

Office Action issued on Jan. 27, 2014 by the Chinese Patent Office in corresponding Chinese Patent Application No. 201080051025.4. (5 pages).

Office Action (Decision of Rejection) dated May 8, 2012, issued by the Japanese Patent Office in the corresponding Japanese Patent Application No. 2009-257800 and an English translation thereof. (4 pages).

International Search Report (PCT/ISA/210) issued on Feb. 8, 2011, by Japanese Patent Office as the International Searching Authority for International Application No. PCT/JP2010/006534.

* cited by examiner

AIR-CONDITIONING APPARATUS

TECHNICAL FIELD

The present invention relates to an air-conditioning apparatus provided with a compressor, and more particularly to control of heating means that heats the compressor which is not in operation.

BACKGROUND ART

In a device, such as an air-conditioning apparatus equipped with a refrigeration cycle, there are cases in which a refrigerant stagnates in a compressor while the device is not in operation. For example, as is the case with an air-conditioning apparatus where a heat exchanger, which is a component of the air-conditioning apparatus, is disposed outdoors, viscosity of the lubricant oil in the compressor decreases along with drop of concentration due to dissolving of the refrigerant stagnated in the compressor to the lubricant oil in the compressor. When the compressor is started under such a condition, the lubricant oil having low viscosity is supplied to the rotating shaft and the compression unit of the compressor, creating risk of burnout due to poor lubrication. Furthermore, when a liquid level of the lubricant oil in the compressor increases due to the dissolving of the refrigerant, a starting load of the compressor increases, which is identified as an over current at the start-up of the air-conditioning apparatus, and a start failure of the air-conditioning apparatus is caused.

As a way to solve the above problem, there is a method in which stagnation of refrigerant in the compressor is suppressed by heating the compressor not in operation. As for the method of heating the compressor, there is a method of energizing an electric heater wound around the compressor, and a method of applying low voltage high frequency current to a coil of a motor installed in the compressor to heat the compressor by Joule heat generated in the coil without rotation of the motor.

That is, with the above method, the compressor is heated in order to prevent the refrigerant from stagnating in the compressor while not in operation, and, accordingly, power will be consumed even while the compressor is suspended. As a measure to this problem, a control method of suppressing the amount of power that is consumed to prevent the refrigerant from stagnating in the compressor is disclosed in which an outdoor air temperature detected by a temperature detecting means is used to determine if heating of the compressor is required, and when determined that heating is not required, the heating of the compressor is stopped (see Patent Literature 1, for example). Specifically, the compressor is heated when the outdoor temperature is equal to or below a predetermined temperature in which the refrigerant may stagnate in the compressor and when the temperature is equal to or below a predetermined temperature in which the compressor is deemed as not in operation.

Further, a control method of suppressing the amount of power that is consumed to prevent the refrigerant from stagnating in the compressor is disclosed in which a discharge temperature of the compressor detected by a temperature detecting means and a discharge pressure of the compressor detected by a pressure detecting means provided in the air-conditioning apparatus are used to estimate a state of the compressor, determining if heating of the compressor is required or not, and when determined that heating is not required, the heating of the compressor is stopped (see Patent Literature 2, for example). Specifically, the refrigerant saturation temperature is converted from the compressor discharge pressure. Then, when the compressor discharge temperature is equal to or below the refrigerant saturation temperature, it is determined that the refrigerant has been liquefied and has stagnated, and the compressor is heated.

CITATION LIST

Patent Literature

Patent Literature 1: Japanese Unexamined Patent Application Publication No. 2000-292014

Patent Literature 2: Japanese Unexamined Patent Application Publication No. 9-113039

SUMMARY OF INVENTION

Technical Problem

For the refrigerant to stagnate, there has to be condensation of the gas refrigerant in the compressor. The condensation of the refrigerant occurs by the difference in temperature of the compressor shell covering the compressor and the refrigerant, in such a case in which the shell temperature is lower than the refrigerant temperature in the compressor, for example. In contrast, when the temperature of the compressor shell is higher than the temperature of the refrigerant, no condensation will occur, and there will be no need to heat the compressor.

However, in considering merely the outdoor air temperature representing the refrigerant temperature in Patent Literature 1, when the temperature of the compressor is higher than the outdoor air temperature, the refrigerant will not condense. Albeit, the compressor is heated even when refrigerant does not stagnate in the compressor. Disadvantageously, power is wastefully consumed.

It has been described above that when the refrigerant stagnates in the compressor, concentration and viscosity of the lubricant oil drop and there will be a risk of burnout in the shaft of the compressor. However, for the rotation shaft or the compression unit of the compressor to actually burnout, there has to be a decrease in the concentration of the lubricant oil to a predetermined value. That is, the compressor will not be in a state in which burnout occurs when the condensation of the lubricant oil is high and the stagnating refrigerant is equal to or below a predetermined value.

However, in Patent Literature 2, the liquefaction of the refrigerant is determined by the refrigerant saturation temperature that is converted from the discharge temperature and the discharge pressure, and the compressor is heated even when the concentration of the lubricant oil is high. Disadvantageously, power is consumed wastefully after all.

The present invention is made to overcome the above problems, and an object is to obtain an air-conditioning apparatus that is capable of appropriately determining the state of the refrigerant stagnated in the compressor and suppressing power consumption while the air-conditioning apparatus is not in operation.

Solution to Problem

An air-conditioning apparatus according the invention includes: a refrigerant circuit connecting a compressor, a heat source side heat exchanger, an expansion valve, and a use side heat exchanger circularly in order with a refrigerant piping; a compressor heating means heating the compressor when the compressor is not in operation; a compressor temperature detection means detecting a surface temperature of the compressor (hereinafter, referred to as compressor temperature); a refrigerant temperature detection means detecting a temperature of a refrigerant in the compressor; and a controller controlling a heating operation to the compressor, which is carried out by the compressor heating means, in which the controller calculates a change rate of the compressor temperature (hereinafter, referred to as compressor temperature change rate) per a predetermined time on the basis of the compressor temperature, calculates a change rate of the refrigerant temperature (hereinafter, referred to as refrigerant temperature change rate) per a predetermined time on the basis of the refrigerant temperature, and does not allow the compressor heating means to carry out the heating operation to the compressor when the compressor temperature change rate is larger than the refrigerant temperature change rate while the compressor is not in operation.

Advantageous Effects of Invention

In the air-conditioning apparatus according to the invention, while the compressor is not in operation, when the compressor temperature change rate is higher than the refrigerant temperature change rate, it is identified that the entire liquid refrigerant in the lubricant oil in the compressor has been gasified and the heating operation of the compressor is ended. Accordingly, heating of the compressor even after the entire liquid refrigerant in the lubricant oil has been gasified can be prevented, and power while the air-conditioning apparatus is suspended, that is, standby power consumption can be suppressed.

DESCRIPTION OF EMBODIMENT

Embodiment 1

General Configuration of Air-Conditioning Apparatus 50

Figure 1:
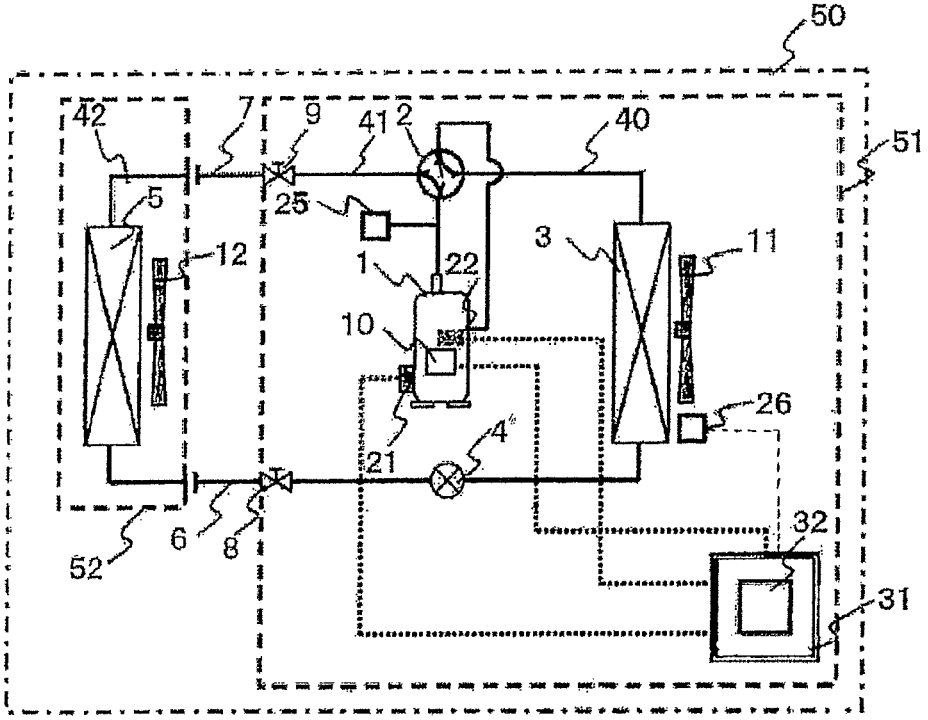
FIG. 1 is a general configuration diagram illustrating an air-conditioning apparatus 50 according to Embodiment of the invention.

FIG. 1 is a general configuration diagram illustrating an air-conditioning apparatus 50 according to Embodiment of the invention.

As illustrated in FIG. 1, an air-conditioning apparatus 50 includes an outdoor unit 51, an indoor unit 52, and a refrigerant circuit 40 that is a circuit communicating the refrigerant circulating through the outdoor unit 51 and the indoor unit 52.

The refrigerant circuit 40 includes an outdoor refrigerant circuit 41 that is a heat source side refrigerant circuit provided with the outdoor unit 51, an indoor refrigerant circuit 42 that is a use side refrigerant circuit provided with the indoor unit 52, and a liquid side connecting piping 6 and a gas side connecting piping 7 that connects the outdoor refrigerant circuit 41 and the indoor refrigerant circuit 42.

The outdoor refrigerant circuit 41 includes at least a compressor 1, a four-way valve 2, an outdoor heat exchanger 3, an expansion valve 4, liquid side stop valve 8 and gas side stop valve 9, and a refrigerant piping connecting the above. In this outdoor refrigerant circuit 41, a refrigerant piping connects the gas side stop valve 9, the four-way valve 2, the compressor 1, the four-way valve 2, the outdoor heat exchanger 3, the expansion valve 4, and the liquid side stop valve 8 in the above order. In the outdoor refrigerant circuit 41, a pressure sensor 25 that detects refrigerant pressure is disposed in a refrigerant piping that is connected to a refrigerant suction portion of the compressor 1.

It should be noted that the outdoor heat exchanger 3 and pressure sensor 25 respectively corresponds to a "heat source side heat exchanger" and a "refrigerant pressure detection means" of the invention.

The compressor 1 compresses gas refrigerant sucked therein and discharges the gas refrigerant as a high-temperature high-pressure gas refrigerant. The compressor 1 is provided with a compressor heating unit 10 that heats the compressor 1, a compressor temperature sensor 21 that detects the surface temperature of the compressor 1, that is, the compressor temperature, and a refrigerant temperature sensor 22 that detects the refrigerant temperature in the compressor 1.

It should be noted that the compressor heating unit 10, the compressor temperature sensor 21, and the refrigerant temperature sensor 22 respectively correspond to a "compressor heating means", a "compressor temperature detection means", and a "refrigerant temperature detection means".

The four-way valve 2 switches the refrigerant flow channel of the refrigerant circuit 40, depending on whether the air-conditioning apparatus 50 is operating as a cooling apparatus or operating as a heating apparatus. When the air-conditioning apparatus 50 operates as a cooling apparatus, the four-way valve 2 switches the refrigerant channel so that the refrigerant flows in the order of the gas side stop valve 9, the four-way valve 2, the compressor 1, the four-way valve 2, the outdoor heat exchanger 3, the expansion valve 4, and the liquid side stop valve 8. On the other hand, when the air-conditioning apparatus 50 operates as a heating apparatus, the four-way valve 2 switches the refrigerant channel so that the refrigerant flows in the order of the liquid side stop valve 8, the expansion valve 4, the outdoor heat exchanger 3, the four-way valve 2, the compressor 1, the four-way valve 2, and the gas side stop valve 9.

It should be noted that when the air-conditioning apparatus does not require the refrigerant circuit 40 to switch the flow channel, in such a case in which the apparatus is used exclusively as a cooling apparatus or a heating apparatus, then, the configuration may be such that no four-way valve 2 is provided.

The outdoor heat exchanger 3 is, for example, a fin-and-tube heat exchanger and exchanges heat between the refrigerant flowing therethrough and the outside air. Further, an outdoor fan 11 to facilitate heat exchange is provided in the vicinity of the outdoor heat exchanger 3.

The expansion valve 4 decompresses the refrigerant that has flowed therein so as to facilitate gasification of the refrigerant when in the outdoor heat exchanger 3 or in the indoor heat exchanger 5, which will be described later.

The liquid side stop valve 8 and the gas side stop valve 9 open or close respective refrigerant channel, however, after the installment of the air-conditioning apparatus 50, the valves are each in an opened state. Further, the above mentioned liquid side connecting piping 6 is connected to the liquid side stop valve 8, and the above mentioned gas side connecting piping 7 is connected to the gas side stop valve 9.

In addition to the above described outdoor refrigerant circuit 41, the outdoor unit 51 includes a controller 31.

The controller 31 includes an arithmetic unit 32. Further, the controller 31 is connected to the above mentioned compressor heating unit 10, the compressor temperature sensor 21, the refrigerant temperature sensor 22, and the pressure sensor 25. Furthermore, the controller 31 controls the operation control of the air-conditioning apparatus 50 and the heat operation by the compressor heating unit10, which will be described later, based on the detected values of the compressor temperature sensor 21, the refrigerant temperature sensor 22, and the pressure sensor 25. Still further, during the suspension of the air-conditioning apparatus 50, that is, while the compressor 1 is not in operation, the controller 31 is configured such that a motor unit 62 of the compressor 1, which will be described later, is energized while the motor has an open phase. Specifically, the motor unit 62 that has been energized while having an open phase does not rotate, Joule heat is generated by the current flowing into the coil, and, accordingly, the compressor 1 is heated. In other words, while the air-conditioning apparatus 50 is not in operation, the motor unit 62 functions as the above mentioned compressor heating unit 10.

It should be noted that the configuration of the compressor heating unit 10 is not limited to the motor unit 62, but may be an electric heater that may be separately provided.

It should be noted that the configuration of the compressor heating unit 10 is not limited to the motor unit 62, but may be an electric heater that may be separately provided.

The indoor refrigerant circuit 42 includes at least an indoor heat exchanger 5 and a refrigerant piping that connect the indoor heat exchanger 5 to the above mentioned gas side connecting piping 7 and liquid side connecting piping 6.

It should be noted that the indoor heat exchanger 5 corresponds to a "use side heat exchanger" of the invention.

The indoor heat exchanger 5 is, for example, a fin-and-tube heat exchanger and exchanges heat between the refrigerant flowing therethrough and the inside air. Further, an indoor fan 12 to facilitate heat exchange is provided in the vicinity of the indoor heat exchanger 5.

[Interior Configuration and Operation of Compressor 1]

Figure 2:
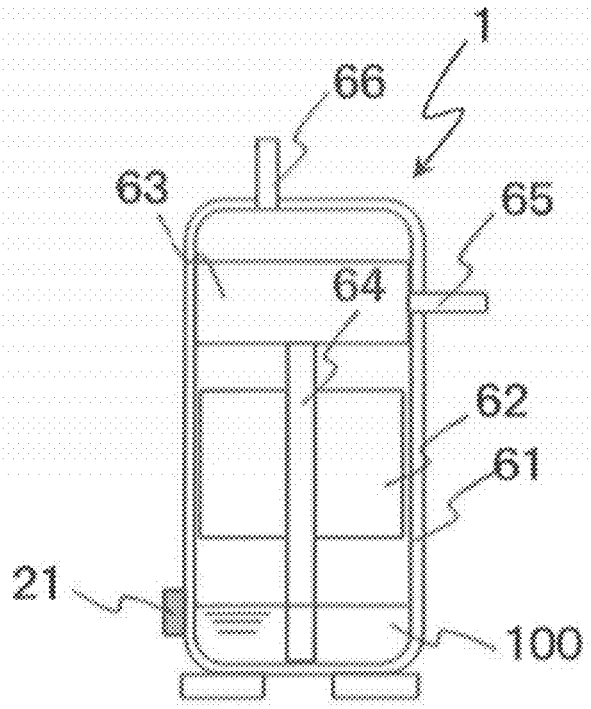
FIG. 2 is a configuration diagram illustrating an interior of a compressor 1 of the air-conditioning apparatus 50 according to Embodiment 1 of the invention.

FIG. 2 is a configuration diagram illustrating an interior of a compressor 1 of the air-conditioning apparatus 50 according to Embodiment 1 of the invention.

As illustrated in FIG. 2, the compressor 1 is, for example, a fully hermetic compressor and includes at least a compressor shell unit 61 that is an outer shell of the compressor 1, the motor unit 62 that allows the compression unit 63, described later, to undergo a compression operation of the refrigerant, the compression unit 63 that compresses the refrigerant, a rotation shaft 64 that rotates in accordance with the rotation operation of the motor unit 62, discharge unit 65 that discharges the compressed gas refrigerant from the compression unit 63, and a suction unit 66 that sucks the refrigerant into the compression unit 63. Further, the compressor shell unit 61 is provided with a compressor temperature sensor 21 that detects the surface temperature of the shell unit, and in the compressor 1, lubricant oil 10 that is provided to the compression unit 63 and the rotation shaft 64, which is used for lubricating the operation is stored.

The motor unit 62 includes a three-phase motor in which power is supplied through an inverter (not illustrated). When the output frequency of the inverter changes, the rotation speed of the motor unit 62 changes, and the compression capacity of the compression unit 63 changes.

The refrigerant that has been sucked into the suction unit 66 is sucked into the compression unit 63 and is compressed. The refrigerant that has been compressed in the compression unit 63 is temporarily released into the compressor shell unit 61 and is then discharged from the discharge unit 65. At this instance, the compressor 1 is at a high pressure inside.

[Time-Dependent Change of Quantity of State while Compressor 1 is Undergoing Heating Operation]

Figure 3:
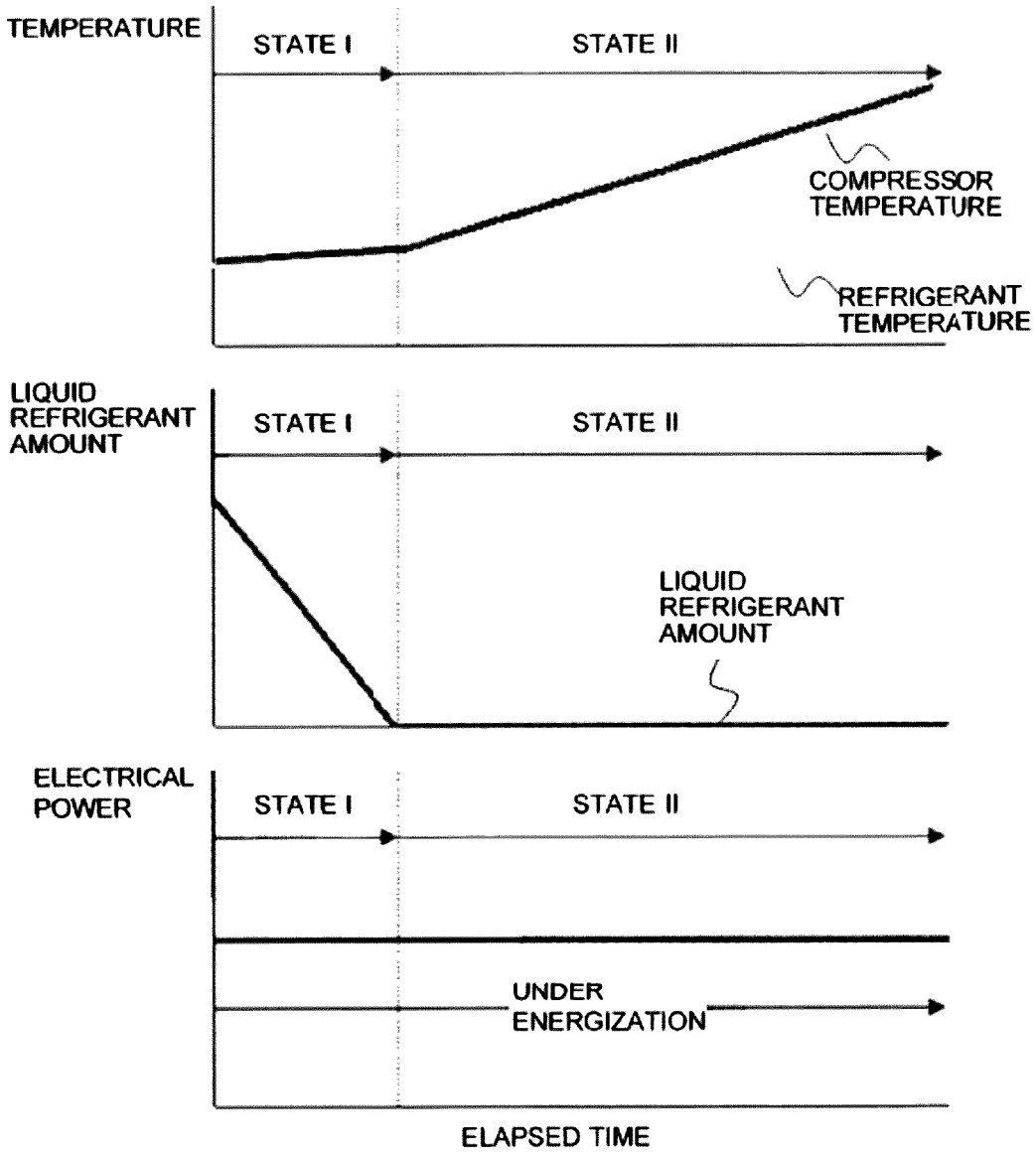
FIG. 3 is a diagram showing time-dependent changes in the temperature of the compressor 1, the temperature of a refrigerant in the compressor 1, and a liquid refrigerant amount, while the compressor 1, according to the air-conditioning apparatus 50 of Embodiment 1, is not in operation.

FIG. 3 is a diagram showing time-dependent changes in the temperature of the compressor 1, the temperature of a refrigerant in the compressor 1, and a liquid refrigerant amount, while the compressor 1, according to the air-conditioning apparatus 50 of Embodiment 1, is not in operation.

While the air-conditioning apparatus 50 is suspended, the refrigerant in the refrigerant circuit 40 condenses and stagnates at a portion where the temperature is the lowest among the components. Therefore, when the temperature of the refrigerant is lower than the temperature of the compressor 1, there is a possibility of stagnation of refrigerant in the compressor 1. When the refrigerant condenses and stagnates in the compressor 1, the refrigerant dissolves into the lubricant oil 100, thus causing the concentration of the lubricant oil to drop and the viscosity thereof to drop, too. When the compressor 1 is started under such a condition, the lubricant oil 100 having low viscosity is supplied to the compression unit 63 and the rotation shaft 64, thus creating risk of burnout due to poor lubrication. Furthermore, when a liquid level of the lubricant oil 100 in the compressor 1 increases due to the stagnation of the refrigerant, a starting load of the compressor 1 increases, which is identified as an over current at the start-up of the air-conditioning apparatus 50, and a start failure of the air-conditioning apparatus 50 is caused.

Accordingly, while the air-conditioning apparatus 50 is suspended, that is, while the condenser 1 is not in operation, the drop of concentration of the lubricant oil 100 can be restrained by having the controller 31 control the compressor heating unit 10 so that the compressor 1 is heated, and due to the evaporation of the liquid refrigerant that is dissolved in the lubricant oil 100 in the compressor 1, the amount of refrigerant dissolved in the lubricant oil 100 is reduced.

In FIG. 3, a time-dependent change of the compressor temperature, refrigerant temperature, and the amount of liquid refrigerant is shown, when the compressor 1, which has stagnated liquid refrigerant therein, is heated by the compressor heating unit 10. However, the outdoor air temperature is assumed not to change, and thus the refrigerant temperature is constant. As shown in FIG. 3, state I illustrates a state from which the compressor heating unit 10 starts to heat the compressor 1 to which the liquid refrigerant in the lubricant oil 100 is totally gasified. In addition, state II illustrates a state after the liquid refrigerant in the lubricant oil 100 has been totally gasified.

In state I, since the liquid refrigerant is dissolved in the lubricant oil 100 in the compressor 1, and since most of the quantity of heat provided by the compressor heating unit 10 is made to contribute to the gasification of the liquid refrigerant, the compressor temperature detected by the compressor temperature sensor 21 hardly changes. However, when entering state II after all the liquid refrigerant has been gasified, since the quantity of heat provided by the compressor heating unit 10 is made to contribute to the increase of the compressor temperature, the compressor temperature increases at a predetermined inclination as shown in FIG. 3. In other words, the controller 31 can determine whether liquid refrigerant is stagnated in the compressor 1 by the rate of change of the compressor temperature in a predetermined period.

[Heating Control Operation of Compressor 1]

Figure 4:
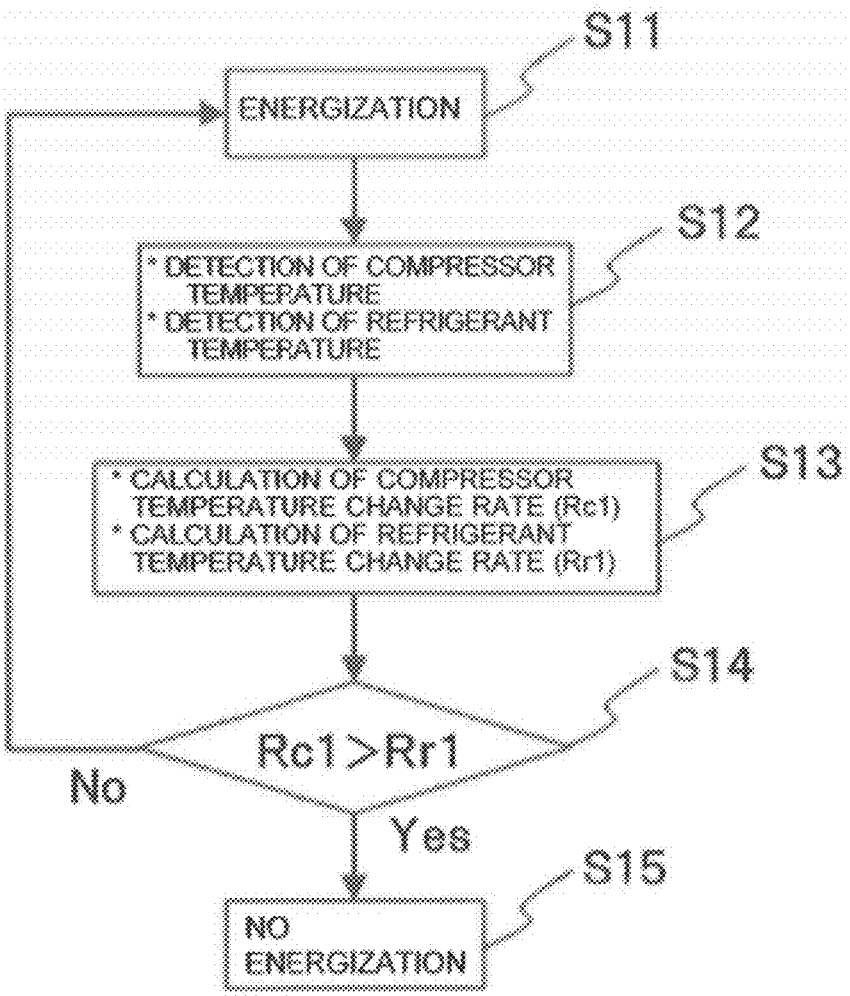
FIG. 4 is a flowchart illustrating a heating control operation of the compressor 1 of the air-conditioning apparatus 50 according to Embodiment 1 of the invention.

FIG. 4 is a flowchart illustrating a heating control operation of the compressor 1 of the air-conditioning apparatus 50 according to Embodiment 1 of the invention.

[S11]

After the suspension of the air-conditioning apparatus 50, the controller 31 allows the motor unit 62 having an open phase to be energized and to operate as the compressor heating unit 10, and heats the compressor 1.

[S12]

The controller 31 receives the compressor temperature detected by the compressor temperature sensor 21 and the refrigerant temperature detected by the refrigerant temperature sensor 22.

[S13]

The arithmetic unit 32 of the controller 31 calculates a compressor temperature change rate Rc1 in a predetermined period based on the received compressor temperature, and calculates a refrigerant temperature change rate Rr1 in a predetermined period based on the received refrigerant temperature.

[S14]

The controller 31 determines which of the compressor temperature change rate Rc1 and the refrigerant temperature change rate Rr1 that has been calculated by the arithmetic unit 32 is higher and which is lower. When the determination result is such that the compressor temperature change rate Rc1 is higher than the refrigerant temperature change rate Rr1, then the process proceeds to step S15. If not, the process returns to step S11.

[S15]

When the compressor temperature change rate Rc1 is determined to be higher than the refrigerant temperature change rate Rr1, the controller 31 identifies that the liquid refrigerant in the lubricant oil 100 in the compressor 1 has been totally gasified, and stops energizing the motor unit 62, and ends the heating operation of the compressor 1.

Advantageous Effects of Embodiment 1

As in the above operation, when the controller 31 determines that the compressor temperature change rate Rc1 is higher than the refrigerant temperature change rate Rr1, the controller 31 identifies that the liquid refrigerant in the lubricant oil 100 in the compressor 1 has been totally gasified and ends the heating operation of the compressor 1. Accordingly, heating of the compressor 1 even after the liquid refrigerant in the lubricant oil 100 has been totally gasified can be prevented, and power while the air-conditioning apparatus 50 is suspended, that is, standby power consumption can be suppressed.

It should be noted that although in the above operation, in step S14 in FIG. 4, the heating operation of the compressor 1 is ended when the controller determines that the compressor temperature change rate Rc1 is higher than the refrigerant temperature change rate Rr1, this is not a limitation. When the compressor temperature is higher than the refrigerant temperature, since stagnation of refrigerant in the compressor 1 will not occur, instead of the controller 31 determining whether the compressor temperature change rate Rc1 is higher than the refrigerant temperature change rate Rr1, or in addition, determination of whether the compressor temperature is higher than the refrigerant temperature may be carried out. When the compressor temperature is higher than the refrigerant temperature, the heating of the compressor 1 with the compressor heating unit 10 may not be carried out. Accordingly, even in a case in which the compressor temperature change rate Rc1 or the refrigerant temperature change rate Rr1 is small and is liable to misdetection, heating of the compressor 1 even when the refrigerant in the compressor 1 is not in a condition to stagnate can be prevented, and power while the air-conditioning apparatus 50 is suspended, that is, standby power consumption can be suppressed.

Figure 5:
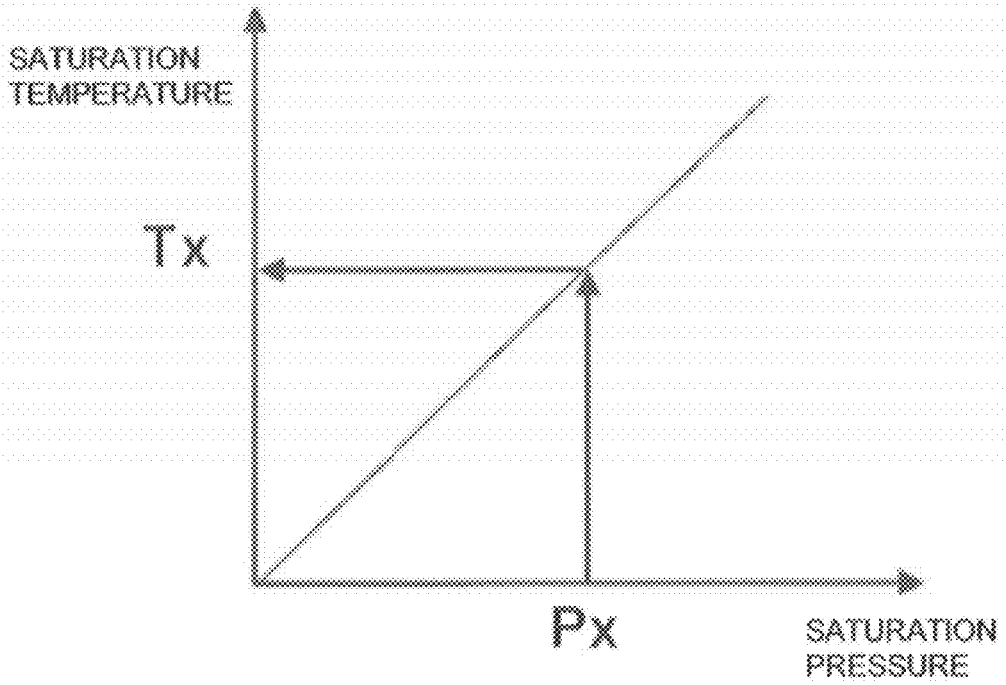
FIG. 5 is a graph showing the relationship between the saturation pressure and the saturation temperature.

Further, in Embodiment 1, when the compressor 1 is not in operation, the pressure in the refrigerant circuit 40 will all be the same (uniform pressure). Furthermore, the refrigerant circuit 40 is a closed circuit, and when there is liquid refrigerant in the circuit, the refrigerant pressure detected by the pressure sensor 25 will be the saturation pressure, and as illustrated in FIG. 5, the saturation pressure Px can be converted into a saturation temperature Tx. Still further, since the refrigerant temperature in the refrigerant circuit 40 is the saturation temperature, while the compressor 1 is suspended, the value of the saturation temperature converted from the saturation pressure detected by the pressure sensor 25 can be used as the refrigerant temperature. Here, the value of the saturation temperature converted from the saturation pressure of the refrigerant detected by the pressure sensor 25 provided in the refrigerant circuit 40 may be used as the refrigerant temperature while the compressor 1 is not in operation. By doing so, there will be no need to detect the refrigerant temperature in the compressor 1 directly, and, thus, the heat control of the compressor 1 can be carried out with a simple configuration in which no refrigerant temperature sensor 22 is required.

In addition, in Embodiment 1, since the outdoor heat exchanger 3 is a heat exchanger that exchanges heat between the refrigerant and outdoor air, the surface area in contact with the outdoor air is large. Further, the outdoor heat exchanger 3 is typically composed of a metal member that has relatively high thermal conductivity such as aluminum or copper, and its heat capacity is relatively small. Accordingly, when the outdoor temperature changes, the temperature of the outdoor heat exchanger 3 changes almost at the same time. In other words, the temperature of the outdoor heat exchanger 3 is generally the same in its value as the outdoor air temperature, and thus can be used as the refrigerant temperature while the compressor 1 is not in operation. Accordingly, temperature detected by an outdoor air temperature sensor 26 existing in typical air-conditioning apparatus in which the outdoor air temperature sensor detects at least the surrounding temperature or the surface temperature of the outdoor heat exchanger 3, can be used as the refrigerant temperature in the compressor 1 while the compressor is not in operation. Since there will be no need to detect the refrigerant temperature in the compressor 1 directly, the heat control of the compressor 1 can be carried out with a simple configuration in which no refrigerant temperature sensor 22 is required.

In addition, in Embodiment 1, lubricant oil 100 is stored in the compressor 1, as described above. In a case in which refrigerant is dissolved in the lubricant oil 100, when the lubricant oil 100 is heated by the compressor heating unit 10, due to the effect of the gasification of the refrigerant in the lubricant oil 100 and the specific heat of the lubricant oil 100, the temperature of the lubricant oil 100 is lower than the temperature of the surface of the compressor 1 above the oil surface of the lubricant oil 100. Further, the temperature of the lubricant oil 100 is substantially the same as the temperature of the surface of the compressor 1 below the oil surface of the lubricant oil 100. In contrast, in a case in which refrigerant in the lubricant oil 100 is totally gasified, the temperature of the lubricant oil 100 is substantially the same as the temperature of the surface of the compressor 1 above the oil surface of the lubricant oil 100. The compressor temperature sensor 21 may be disposed at a position below the oil surface of the lubricant oil 100 in the compressor 1, in particular, on the bottom surface of the shell of the compressor 1. By doing so, the compressor temperature sensor 21 can detect a temperature that is substantially the same as the lubricant oil 100, in which the temperature of the lubricant oil can be deemed as the compressor temperature. Hence, whether the refrigerant in the lubricant oil 100 has gasified can be reliably confirmed.

Furthermore, in Embodiment 1, as illustrated in FIG. 1, the pressure sensor 25 is disposed in the compressor 1, that is, the pressure sensor 25 is disposed in the refrigerant circuit 40 so that the pressure value that is the same or near that in the compressor shell unit 61 can be detected. In addition, the inside of the shell of the compressor 1 differs depending on the shell type. For example, the pressure in the compressor called a high-pressure shell is close to the discharge pressure and the pressure in the compressor called a low-pressure shell is close to the suction pressure. That is to say, the configuration of the pressure sensor 25 is not limited to the one depicted in FIG. 1, but may be a configuration having a pressure sensor in each of the refrigerant pipings on the suction side and discharge side of the compressor 1. This configuration allows an accurate detection of the pressure in the compressor according to the type of the compressor.

Embodiment 2

In Embodiment 2, points that differ to the air-conditioning apparatus 50 according to Embodiment 1 will be described mainly.

The configuration of an air-conditioning apparatus 50 of Embodiment 2 is the same as the configuration of the air-conditioning apparatus 50 of Embodiment 1.

[Time-Dependent Change of Quantity of State while Compressor 1 is Undergoing Heating Operation]

Figure 6:
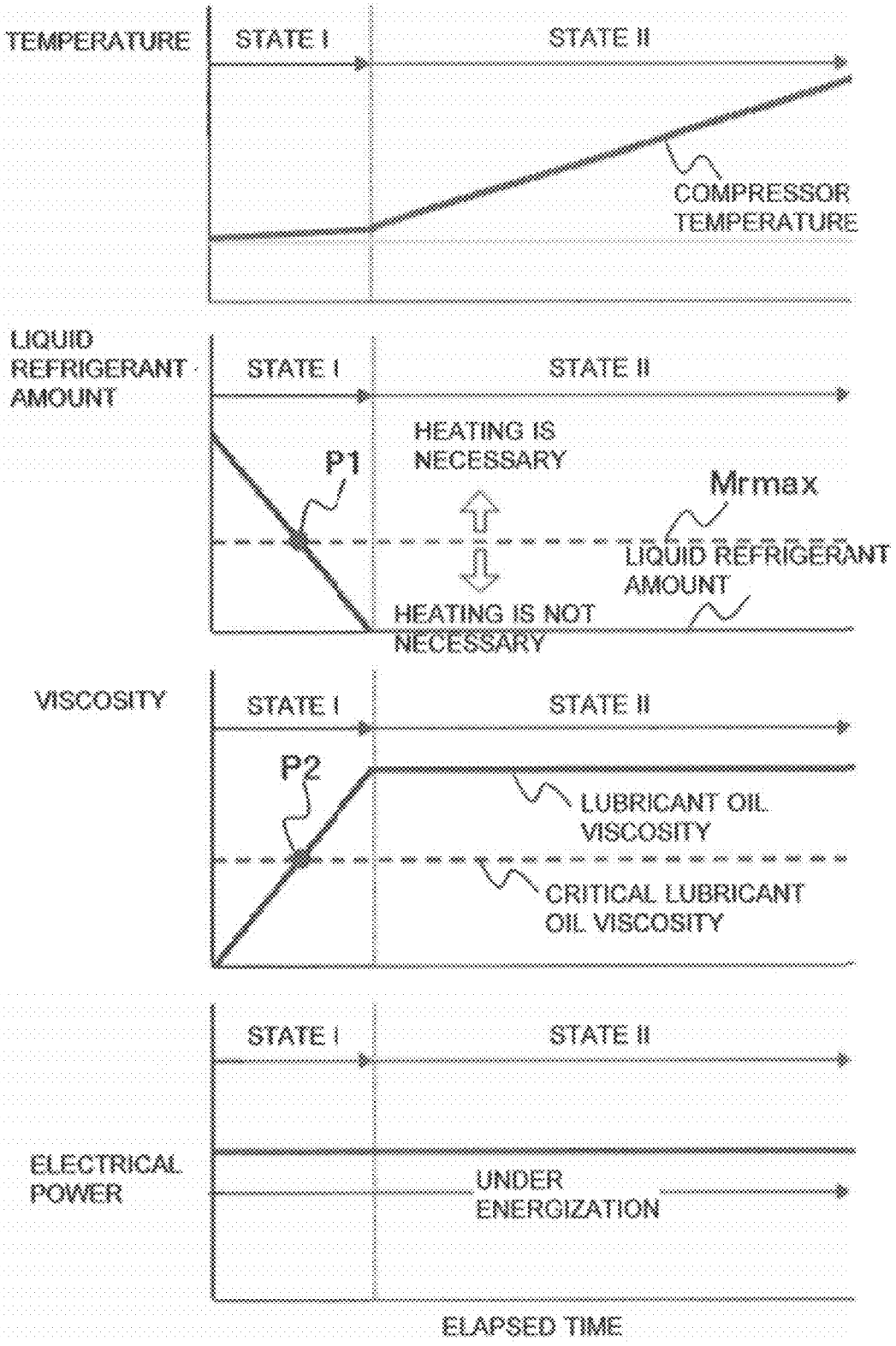
FIG. 6 is a diagram showing time-dependent changes in the temperature of a compressor 1, a liquid refrigerant amount in the compressor 1, and the viscosity of a lubricant oil 100, while the compressor 1, according to an air-conditioning apparatus 50 of Embodiment 2, is not in operation.

FIG. 6 is a diagram showing time-dependent changes in the temperature of a compressor 1, a liquid refrigerant amount in the compressor 1, and the viscosity of a lubricant oil 100, while the compressor 1, according to the air-conditioning apparatus 50 of Embodiment 2, is not in operation.

As illustrated in FIG. 6, when a controller 31 makes a compressor heating unit 10 heat the compressor 1, the liquid refrigerant that has dissolved into the lubricant oil 100 in the compressor 1 is gasified and is reduced. Then, due to the gasification of the liquid refrigerant, the concentration of the lubricant oil 100 in the compressor 1 increases, and the viscosity (hereinafter referred to as "lubricant oil viscosity") increases accordingly. If a liquid refrigerant amount Mrmax (the refrigerant amount depicted by point P1 in FIG. 6, hereinafter referred to as "permissible liquid refrigerant amount"), which is the amount of liquid refrigerant that can ensure the lubricant oil viscosity of which no failure will occur, is certain, then the compressor 1 does not have to be heated until reaching a state (state II) in which there is no amount of liquid refrigerant in the lubricant oil 100 in the compressor 1, as long as the amount of refrigerant is equal to or less than the permissible liquid refrigerant amount Mrmax. The concentration of the lubricant oil 10 when the amount of refrigerant is permissible liquid refrigerant amount Mrmax will be, hereinafter, referred to as "critical lubricant oil viscosity" (the viscosity depicted by point P2 in FIG. 6). If the amount of liquid refrigerant dissolved in the lubricant oil 100 in the compressor 1 can be estimated, then the heating of the compressor 1 can be suppressed to the minimum amount possible.

[Condition of Stagnation of Liquid Refrigerant Occurring while Compressor 1 is not in Operation]

Figure 7:
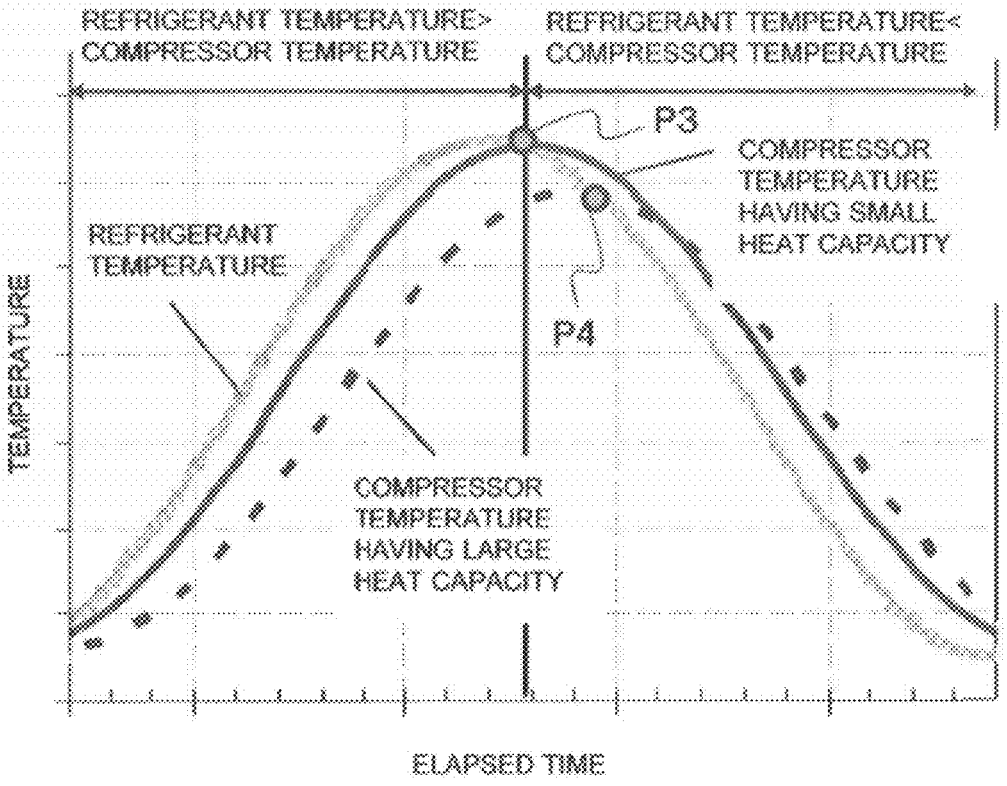
FIG. 7 is a diagram showing time-dependent changes in the temperature of a refrigerant in the compressor 1 and the temperature of the compressor 1 according to the air-conditioning apparatus 50 of Embodiment 2.

FIG. 7 is a diagram showing time-dependent changes in the temperature of the refrigerant in the compressor 1 and the temperature of the compressor 1 according to the air-conditioning apparatus 50 of Embodiment 2. Referring to FIG. 7, development of the stagnation of liquid refrigerant while the compressor 1 is not in operation will be described.

The outdoor air temperature periodically changes, and the refrigerant temperature while the compressor 1 is not in operation changes along with the change of the outdoor air temperature. However, at this moment, the change of the compressor temperature and its followability differs depending on the heat capacity of the compressor 1. Influenced by the heat capacity of the compressor 1, the compressor temperature follows the refrigerant temperature with a lag. A compressor 1 with a small heat capacity (a light compressor, for example) tends to follow the change of refrigerant temperature more, while a compressor 1 with a large heat capacity (a heavy compressor, for example) tends to follow the change of refrigerant temperature less widening the temperature gap between the refrigerant temperature and the compressor 1 temperature. Further, when the compressor temperature is lower than the refrigerant temperature, condensation of gas refrigerant occurs in the compressor 1, and liquid refrigerant stagnates in the compressor 1. For example, as shown in FIG. 7, assuming that the refrigerant temperature changes and the heat capacity of the compressor 1 is small, then, in the elapsed time before point P3, the refrigerant temperature is higher than the compressor temperature and there is stagnation of liquid refrigerant in the compressor 1. However, in the elapsed time after point P3, the compressor temperature is higher than the refrigerant temperature and there is no stagnation of refrigerant in the compressor 1. On the other hand, when the heat capacity of the compressor 1 is large, then, in the elapsed time before point P4, the refrigerant temperature is higher than the compressor temperature and there is stagnation of liquid refrigerant in the compressor 1. However, in the elapsed time after point P4, the compressor temperature is higher than the refrigerant temperature and there is no stagnation of refrigerant in the compressor 1.

[Calculating Method of Refrigerant Amount in Lubricant Oil 100]

Subsequently, the relationship between a liquid refrigerant amount Mr that has dissolved into the lubricant oil 100 in the compressor 1, a refrigerant temperature Tr in the compressor 1, and a compressor temperature Ts of the compressor 1 will be described. Here, to postulate a case in which refrigerant stagnates in the compressor 1, a state in which the compressor temperature Ts is smaller than the refrigerant temperature Tr is assumed.

A relationship between an amount of heat exchange Qr between the refrigerant in the compressor 1 and the compressor 1, and the refrigerant temperature Tr, and the compressor temperature Ts is expressed by the following equation (1).

$$Qr=A\cdot K\cdot(Tr-Ts) \tag{1}$$

Where, A is a heat transfer area in which the compressor 1 and the refrigerant in the compressor 1 exchanges heat, K is an overall heat transfer coefficient between the compressor 1 and the refrigerant in the compressor 1.

On the other hand, since the refrigerant in the compressor 1 stagnates according to the temperature difference between the compressor temperature Ts and the refrigerant temperature Tr, the relationship between the amount of heat exchange Qr and an amount of change of the liquid refrigerant dMr in the lubricant oil 100 in relation to the amount of heat exchange Qr and time change dt is expressed by the following equation (2), where, dH is latent heat of the refrigerant.

$$Qr=dMr\cdot dH/dt \tag{2}$$

The latent heat dH is a value determined by the refrigerant characteristics.

Given the above equations (1) and (2), the relationship between the amount of change of the liquid refrigerant dMr in relation to the time change dt, the refrigerant temperature Tr, and the compressor temperature Ts is expressed by the following equation (3).

$$dMr/dt=F\cdot(Tr-Ts) \tag{3}$$

Assuming that a state in which Ts<Tr has continued from a certain time T1 (the amount of liquid refrigerant at this time is assumed to be Mr1) to time T2 (the amount of liquid refrigerant at this time is assumed to be Mr2), then, the amount of stagnated liquid refrigerant Mr (=M2−M1) in the compressor 1 is, given equation (3), expressed by the following equation (4).

$$Mr=Mr2-Mr1=\int F\cdot(Tr-Ts)\cdot dt \tag{4}$$

Here, F is a fixed value which is a value obtained by dividing the product of the heat transfer area A and the overall heat transfer coefficient K with the latent heat dH of the refrigerant. Further, in a case in which the compressor 1 is a high-pressure shell, when assuming that the amount of the liquid refrigerant at the stoppage of the compressor 1 is the initial amount of refrigerant, and that this initial amount of refrigerant is amount of refrigerant Mr1, then there will be no, that is nil, liquid refrigerant, since the compressor 1 just before its stoppage is in a high-temperature high-pressure state. In other words, the amount of stagnating liquid refrigerant in the compressor 1 is proportionate to the time and the temperature difference while in a state in which the compressor temperature Ts is lower than the refrigerant temperature Tr (Ts<Tr), and can be estimated with the above equation (4).

It should be note that although in the above description, the amount of stagnating liquid refrigerant Mr in the compressor 1 is estimated with the above equation (4), it is not limited to the above and may be estimated as described below, for example.

Figure 8:
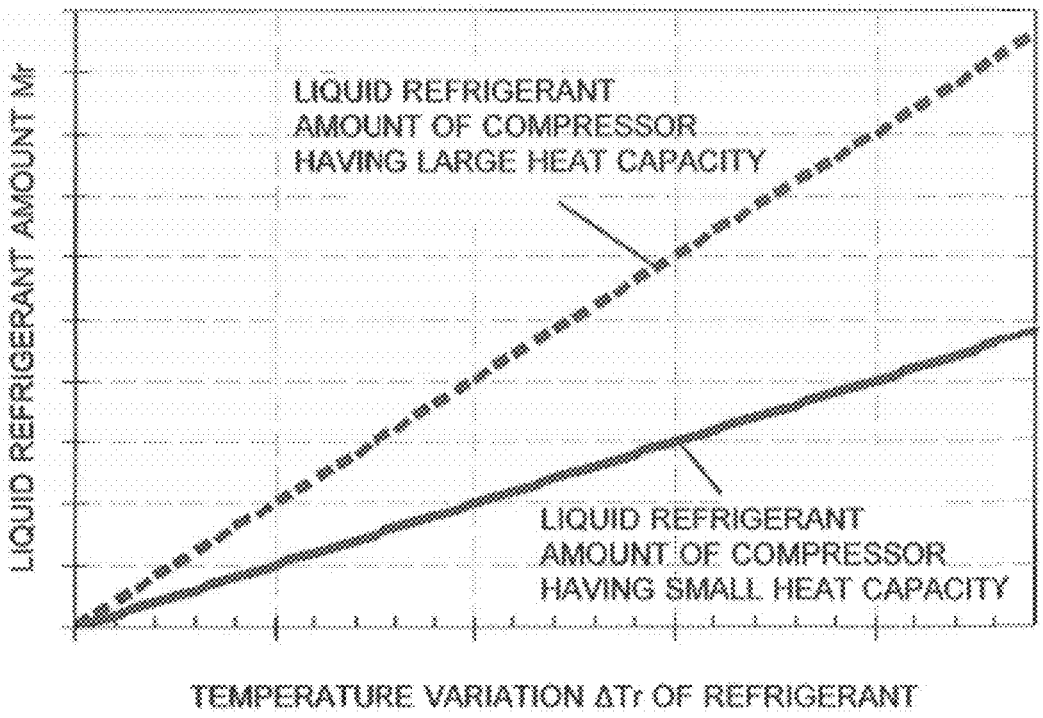
FIG. 8 is a diagram showing the liquid refrigerant amount Mr stagnating in the compressor 1 in relation to the temperature variation $\Delta Tr$ of the refrigerant.

FIG. 8 is a diagram showing the liquid refrigerant amount Mr stagnating in the compressor 1 in relation to a temperature variation ΔTr of the refrigerant. As illustrated in FIG. 7, the change of compressor temperature accompanying the change of refrigerant temperature differs depending on the heat capacity of the compressor 1. Since compressors 1 with larger heat capacity has larger difference between the compressor temperature and the refrigerant temperature, the amount of stagnated liquid refrigerant Mr in the compressors 1 increase. Furthermore, larger the temperature variation ΔTr of the refrigerant, longer the time period in which the compressor temperature is lower than the refrigerant temperature, that is, the time period in which the liquid refrigerant stagnates in the compressor 1, and, thus, the amount of stagnating liquid refrigerant Mr in the compressor 1 increases, as illustrated in FIG. 8. In other words, by understanding the relationship between the temperature variation ΔTr of the refrigerant and the amount of stagnating liquid refrigerant Mr in the compressor 1 in advance, the amount of stagnating refrigerant Mr in the relevant compressor 1 can be estimated.

[Calculating Method of Heating Amount Qh and Heating Duration dTh of Compressor Heating Unit 10]

On the other hand, the quantity of heat required to change the amount of liquid refrigerant Mr2 in the compressor 1 to the amount of liquid refrigerant Mr1 (if total gasification, then Mr1=0) is expressed by the following equation (5) using the heating amount Qh and the heating duration dTh of the compressor heating unit 10.

$$Qh\cdot dTh=(Mr2-Mr1)\cdot dH \tag{5}$$

Figure 9:
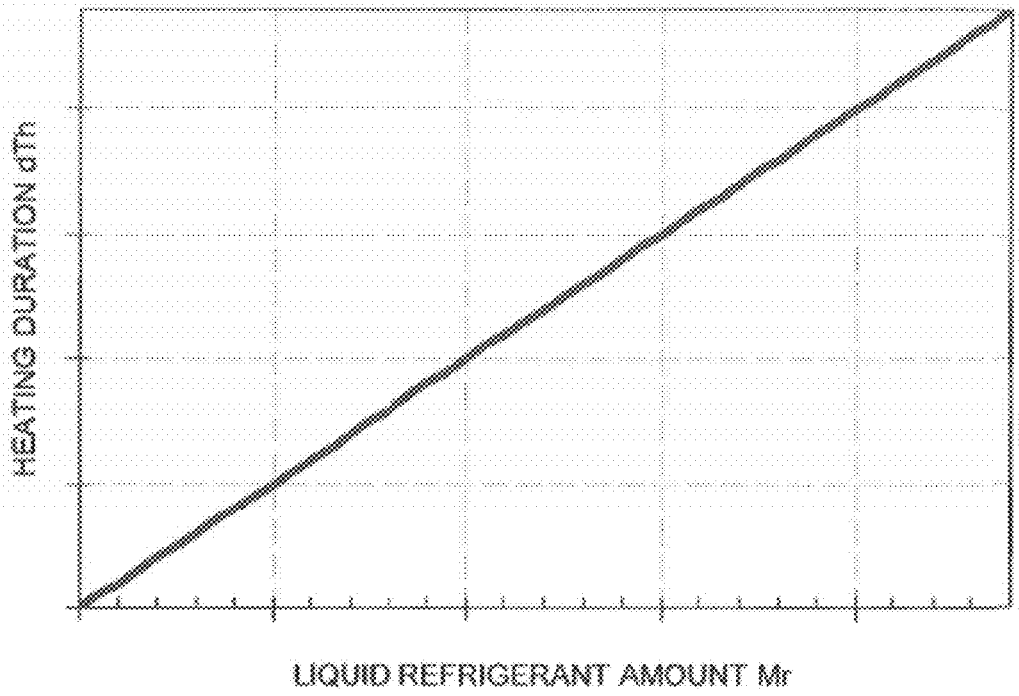
FIG. 9 is a diagram showing the relationship between the heating duration dTh and the evaporating liquid refrigerant amount Mr when the compressor 1 is heated.

As described above, since the latent heat dH is a value determined by the refrigerant characteristics, by manipulating the heating amount Qh and the heating duration dTh of the compressor heating unit 10, the amount of liquid refrigerant Mr in the lubricant oil 100 in the compressor 1 can be controlled to a predetermined amount. For example, when heating amount Qh is constant, then heating duration dTh can be determined so that the above equation (5) is satisfied. As illustrated in FIG. 9, larger the amount of liquid refrigerant evaporated, the longer the heating duration dTh becomes.

[Heating Control of Compressor 1]

Figure 10:
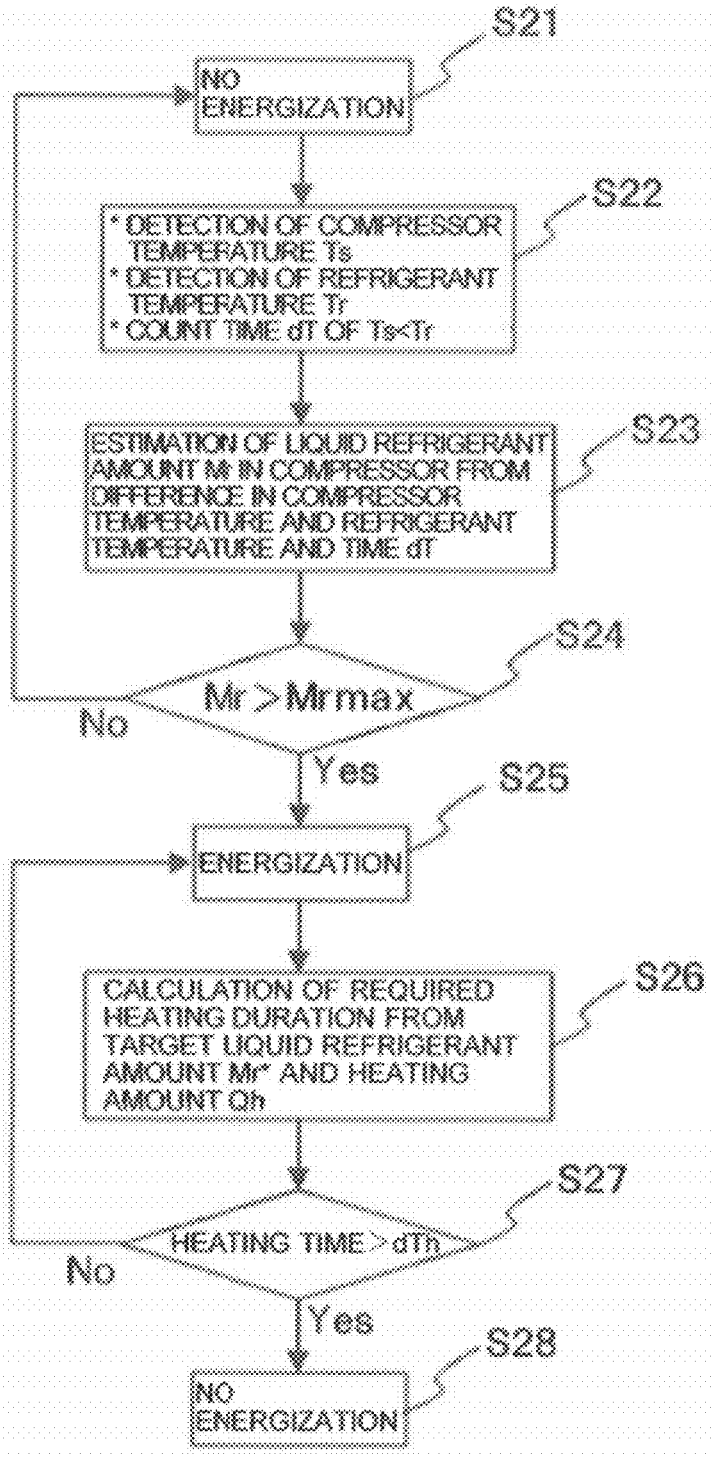
FIG. 10 is a flowchart illustrating a heating control operation of the compressor 1 of the air-conditioning apparatus 50 according to Embodiment 2 of the invention.

FIG. 10 is a flowchart illustrating a heating control operation of the compressor 1 of the air-conditioning apparatus 50 according to Embodiment 2 of the invention.

[S21]

While the air-conditioning apparatus 50 is not in operation, the controller 31 does not energize a motor unit 62, and the compressor 1 is not heated by the compressor heating unit 10.

[S22]

The controller 31 receives the compressor temperature Ts detected by a compressor temperature sensor 21 and the refrigerant temperature Tr detected by a refrigerant temperature sensor 22. Further, an arithmetic unit 32 of the controller 31 counts an elapsed time dT of the state in which Ts<Tr.

[S23]

Based on the compressor temperature Ts, refrigerant temperature Tr, and the elapsed time dT, the arithmetic unit 32 of the controller 31 calculates the amount of liquid refrigerant Mr with the above equation (4).

[S24]

The controller 31 compares the amount of liquid refrigerant Mr with the permissible liquid refrigerant amount Mrmax in the compressor 1. As a result of the comparison, when it is determined that the amount of liquid refrigerant Mr is equal to or smaller than the permissible liquid refrigerant amount Mrmax, the heating of the compressor 1 by the compressor heating unit 10 is determined as unnecessary since the concentration of the lubricant oil 100 is high, and the process returns to step S21. On the other hand, when it is determined that the amount of liquid refrigerant Mr is larger than the permissible liquid refrigerant amount Mrmax, the heating of the compressor 1 by the compressor heating unit 10 is determined as necessary since the concentration of the lubricant oil 100 is low, and the process proceeds to step S25.

[S25]

The controller 31 allows the motor unit 62 having an open phase to be energized and makes the compressor heating unit 10 heat the compressor 1. Here, it is assumed that the heating amount Qh of the compressor 1 by the compressor heating unit 10 is constant.

[S26]

Based on the estimated amount of the liquid refrigerant Mr that has been calculated in step S23, the target amount of the liquid refrigerant Mr*, the heating amount Qh, and the latent heat dH of the refrigerant, the arithmetic unit 32 of the controller 31 determines the heating duration dTh with the above equation (5).

[S27]

The controller 31 counts the elapsed heating time from the start of the heating of the compressor 1 by the compressor heating unit 10, and determines whether the elapsed heating time has exceeded the heating duration dTh. When the determination result is such that the elapsed heating time is equal to or less than the heating duration dTh, it is determined that heating operation of the compressor 1 carried out by the compressor heating unit 10 needs to be continued, and the process returns to step S25. On the other hand, when the elapsed heating time has exceeded the heating duration dTh, it is determined that heating operation of the compressor 1 carried out by the compressor heating unit 10 is not required, and the process proceeds to step S28.

[S28]

The controller 31 stops the energization of the motor unit 62, and ends the heating operation of the compressor 1.

It should be noted that in step S25 and step S26, the heating amount Qh was assumed to be as fixed and the operation of determining the heating duration dTh was carried out with equation (5), but not limited to the this, the heating duration dTh may be fixed and heating amount Qh may be determined with equation (5), and based on the heating amount Qh, the operation of heating the compressor 1 by the amount of heating duration dTh, which is a fixed value, may be carried out.

Advantageous Effects of Embodiment 2

As in the above operation, by controlling the heating operation of the compressor 1 by controlling the heating amount Qh or the Heating time dTh of the compressor heating unit 10, the liquid refrigerant dissolved in the lubricant oil 100 in the compressor 1 is reduced. Accordingly, operation such as heating the compressor 1 even when heating of the compressor 1 is not required any more can be prevented, and power while the air-conditioning apparatus 50 is suspended, that is, standby power consumption can be suppressed.

Furthermore, in Embodiment 2, the condition in which the liquid refrigerant stagnates in the compressor 1, that is, the condition in which the liquid refrigerant accumulates in the compressor 1 is when the compressor temperature Ts is lower than the refrigerant temperature Tr. Under this condition, it is determined that heating of the compressor is necessary. Since the controller 31 carries out a heating operation of the compressor 1 carried out by the compressor heating unit 10 while the air-conditioning apparatus 50 is not in operation, stagnation of liquid refrigerant in the compressor 1 can be suppressed.

It should be noted that in Embodiment 2, the operation of estimating the amount of liquid refrigerant Mr is carried out with the compressor temperature Ts that is detected by the compressor temperature sensor 21 and the refrigerant temperature Tr that is detected by the refrigerant temperature sensor 22, but it is not limited to this, and, as described below, the operation of estimating the amount of liquid refrigerant may be carried out with the compressor temperature that is detected by the compressor temperature sensor 21 and the refrigerant pressure that is detected by the pressure sensor 25.

Figure 11:
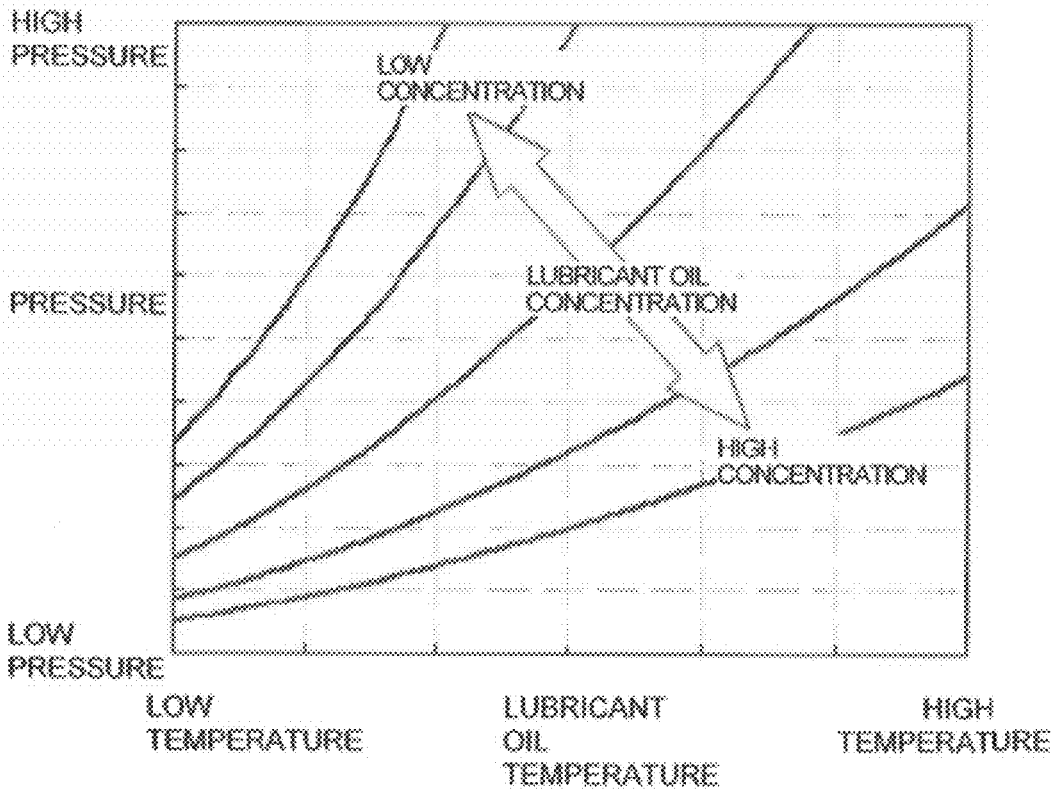
FIG. 11 is a diagram illustrating a solution property of the refrigerant in relation to the lubricant oil 100.

FIG. 11 is a diagram illustrating a solution property of the refrigerant in relation to the lubricant oil 100. From the solution property illustrated in FIG. 11, the concentration of the lubricant oil 100 in the compressor 1 can be estimated using the compressor temperature that is detected by the compressor temperature sensor 21, in which the compressor temperature can be deemed as the lubricant oil temperature, and the refrigerant pressure detected by the pressure sensor 25. Additionally, the amount of liquid refrigerant can be estimated with the amount of lubricant oil 100 in the compressor 1 and the concentration of the lubricant oil 100 that has been estimated above.

Furthermore, with this estimated amount of the liquid refrigerant, an operation of correcting the amount of the liquid refrigerant calculated in the above step S23 may be carried out. In this case, the amount of the liquid refrigerant in the compressor 1 can be estimated with high accuracy, and thus, the controller 31 will be capable of carrying out the heating operation of the compressor 1 carried out by the compressor heating unit 10 with high accuracy.

INDUSTRIAL APPLICABILITY

A refrigeration apparatus that is equipped with a compressor heating means while the compressor is not in operation may be an exemplary application of the invention.

REFERENCE SIGNS LIST

1. compressor; 2. four-way valve; 3. outdoor heat exchanger; 4. expansion valve; 5. indoor heat exchanger; 6. liquid side connecting piping; 7. gas side connecting piping; 8. liquid side stop valve; 9. gas side stop valve; 10. compressor heating unit; 11. outdoor fan; 12. indoor fan; 21. compressor temperature sensor; 22. refrigerant temperature sensor; 25. pressure sensor; 31. controller; 32. arithmetic unit; 40. refrigerant circuit; 41. outdoor refrigerant circuit; 42. indoor refrigerant circuit; 50. air-conditioning apparatus; 51. outdoor unit; 52. indoor unit; 61. compressor shell unit; 62. motor unit; 63. compression unit; 64. rotation shaft; 65. discharge unit; 66. suction unit; 100 lubricant oil.

The invention claimed is:

1. An air-conditioning apparatus, comprising:

a refrigerant circuit connecting a compressor, a heat source side heat exchanger, an expansion valve, and a use side heat exchanger in order with a refrigerant piping;

a compressor heater for heating the compressor when the compressor is not in operation;

a compressor temperature sensor for detecting a compressor temperature;

a refrigerant temperature detection sensor for detecting a refrigerant temperature in the compressor; and a controller configured to:

estimate an amount of liquid refrigerant in the compressor by integrating the temperature difference between the compressor temperature and the refrigerant temperature during a period in which the compressor temperature becomes lower than the refrigerant temperature, and control the heating operation, which is carried out by the compressor heater, on the basis of the estimated liquid refrigerant amount when the compressor is not in operation.

2. The air-conditioning apparatus of claim 1, wherein the controller is configured to control the heating operation, which is carried out by the compressor heater, such that the liquid refrigerant amount in the compressor is changed to an amount equal to or less than a permissible liquid refrigerant amount, which is an amount of liquid refrigerant that can ensure normal operation of the compressor.

3. The air-conditioning apparatus of claim 2, wherein the heating amount of the compressor heater is constant, and the controller configured to calculate a required heating duration using the constant heating amount by the compressor heater in order that the liquid refrigerant amount in the compressor becomes equal to or less than the permissible liquid refrigerant amount, and make the compressor heater carry out the heating operation with the constant heating amount in the calculated heating duration.

4. The air-conditioning apparatus of claim 3, wherein the heating duration is fixed, and the controller is configured to calculate a required heating amount in using the fixed heating duration by the compressor heater in order that the liquid refrigerant amount of the compressor becomes equal to or less than the permissible liquid refrigerant amount, and make the compressor heater carry out the heating operation with the calculated heating amount in the fixed heating duration.

5. An air-conditioning apparatus, comprising:

a refrigerant circuit connecting a compressor, a heat source side heat exchanger, an expansion valve, and a use side heat exchanger in order with a refrigerant piping;

a compressor heater for heating the compressor when the compressor is not in operation;

a compressor temperature sensor for detecting a compressor temperature;

an outdoor air temperature detection sensor for detecting at least one of a surrounding temperature and a surface temperature of the heat source side heat exchanger; and a controller configured to:

control a heating operation, which is carried out by the compressor heater, estimate an amount of liquid refrigerant in the compressor by integrating the temperature difference between the compressor temperature and at least one of the surrounding temperature and the surface temperature during a period in which the compressor temperature becomes lower than at least one of the surrounding temperature and the surface temperature, control the heating operation, which is carried out by the compressor heater, on the basis of the estimated liquid refrigerant amount when the compressor is not in operation.

* * * * *